United States Patent [19]

Machida et al.

[11] Patent Number: 4,822,708

[45] Date of Patent: Apr. 18, 1989

[54] CARRIER FOR USE IN DEVELOPING DEVICE OF ELECTROSTATIC LATENT IMAGE AND PRODUCTION THEREOF

[75] Inventors: Junji Machida, Toyonaka; Junji Ohtani, Osaka; Eiichi Sano, Takatsuki; Masahiro Anno, Sakai; Toshitaro Kohri, Higashiosaka; Yukio Tanigami; Makoto Kobayashi, both of Amagasaki, all of Japan

[73] Assignee: Minolta Camera Kabushiki Kaisha, Osaka, Japan

[21] Appl. No.: 80,489

[22] Filed: Jul. 29, 1987

[30] Foreign Application Priority Data

Aug. 1, 1986 [JP] Japan ..... 61-182239
Aug. 1, 1986 [JP] Japan ..... 61-182241

[51] Int. Cl.[4] ..... G03G 9/14

[52] U.S. Cl. ..... 430/106.6; 430/108; 430/137

[58] Field of Search ..... 430/106.6, 108, 110, 430/903, 138

[56] References Cited

U.S. PATENT DOCUMENTS

| | | | |
|---|---|---|---|
| Re. 31,072 | 11/1982 | Jadwin et al. | 430/99 |
| 3,533,835 | 10/1970 | Hagenbach et al. | 430/110 |
| 3,669,885 | 6/1972 | Wright et al. | 252/62.1 |
| 3,720,617 | 3/1973 | Chatterji et al. | 252/62.1 |
| 3,795,618 | 5/1974 | Kasper | 252/62.1 |
| 3,840,464 | 10/1974 | Van Engeland et al. | 252/62.1 |
| 3,873,356 | 3/1975 | Queener et al. | 430/108 |
| 3,898,170 | 8/1975 | Kasper | 252/62.1 |
| 3,916,065 | 10/1975 | Moriconi | 438/403 |
| 4,013,573 | 3/1977 | Leikhim et al. | 252/89 R |
| 4,062,693 | 12/1977 | Berger | 106/308 |
| 4,493,855 | 1/1985 | Sachdev et al. | 427/41 |
| 4,517,268 | 5/1985 | Gruber et al. | 430/39 |
| 4,518,673 | 5/1985 | Noguchi et al. | 430/108 |
| 4,555,466 | 11/1985 | Okada | 430/106.6 |
| 4,596,812 | 6/1986 | Chidrey, III et al. | 514/256 |
| 4,600,675 | 7/1986 | Iwasa et al. | 430/106.6 |
| 4,609,603 | 9/1986 | Knapp | 430/39 |
| 4,672,016 | 6/1987 | Isoda et al. | 430/108 |
| 4,717,720 | 1/1988 | Shrout et al. | 514/63 |

FOREIGN PATENT DOCUMENTS

| | | |
|---|---|---|
| 57-190957 | 1/1982 | Japan . |
| 57-122449 | 1/1982 | Japan . |
| 60107038 | 11/1983 | Japan . |
| 37553 | 3/1984 | Japan . |
| 59-69762 | 4/1984 | Japan . |
| 59-201064 | 11/1984 | Japan . |
| 59-200262 | 11/1984 | Japan . |
| 59-223458 | 12/1984 | Japan . |
| 60-50543 | 3/1985 | Japan . |
| 147750 | 8/1985 | Japan . |
| 170865 | 9/1985 | Japan . |

OTHER PUBLICATIONS

F. Lions, K. V., Martin, *Journal of the American Chemical Society,* 1957, 79 2733–2738.

*Primary Examiner*—John L. Goodrow
*Attorney, Agent, or Firm*—Burns, Doane, Swecker & Mathis

[57] ABSTRACT

The present invention provides a carrier coated by a polymer particle layer containing fine magnetic particles around a magnetic core, which may contain an electrical charge controlling agent, and the core may be pre-treated with a coupling reagent; the carrier gives excellent clearness to the copy and durability at repeating use.

50 Claims, 3 Drawing Sheets

CARRIER FOR USE IN DEVELOPING DEVICE OF ELECTROSTATIC LATENT IMAGE AND PRODUCTION THEREOF

BACKGROUND OF THE INVENTION

The present invention relates to a carrier for use in a developing device of a latent electrostatic image and production thereof.

In a known developing process in which a magnetic brush is formed on a surface of a developing sleeve by magnetic intensity, a surface of a photosensitive member functioning as a supporter of the latent image or the like is rubbed by a magnetic brush of the magnetic developer, and then the latent image thereon is developed. In the above developing process a mixture of magnetic carriers consisting of iron particles having an average particle size of about 20–200 micrometers and insulating toners having an average diameter of about 5–20 micrometers had been used as the developer.

Such carriers, however, tend toward many problems such as disorder of the latent image and defect of the developed image due to the escape of an electrical charge on the supporter of the latent image through the carrier or adhesion of the carriers into the image parts of the supporter by the injected electrical charge from the developing sleeve when the toner content in the developing agent decreases through continuous use, because the volume specific resistivity of the carrier itself is generally too low, such as less than $10^8$ ohm.cm. Furthermore, when the carriers adhere to the latent image on the photosensitive member, the surface of the member is liable to be damaged due to the hardness of the carriers, at the cleaning of the surface by a blade cleaner and the like.

In order to solve the above problems resin coated carriers had been proposed to give a higher resistivity to such carriers in, for instance, Japanese Patent Publication (Kokai) No. 66264/1985, Japanese Patent Publication (Kokai) No. 66265/1985, Japanese Patent (Kokai) No. 660/1982, Japanese Patent Publication (Kokai) No. 60658/85 and so on. The carriers disclosed in the above prior arts are generally produced by coating carriers with a resin solved in a suitable solvent, and drying them.

These carriers have a resin coating layer thereon, but have still many problems such as difficulty of quality control of image attributed to accumulation of electrical charge on the carriers, residual solvent in the carrier core, and low electrical resistance. The electrical resistance can be increased by thickening the resinous coating layer, but it increases the cost of the carrier, because plural coatings will be required to obtain such a thicker layer.

Further, according to the above methods numerous fine pores are formed in the coated resin layer when the solvent vaporizes, and then the layer is liable to peel off around the pores, so that the durability is lower.

Furthermore, the carrier coated with the resinous solution is so unstable with respect to chargeability that the high density of the copied image cannot be achieved repeated use because the charge amount is increased by it.

The toner transported from the developing sleeve to the part of electrostatic latent image is released from the carrier surface to the latent image to make it visible. At that time as copy of an even and broad black area cannot be achieved by the self-bias of the latent image alone because of the edge effect, the quality of the image must be controlled by means of a bias voltage applied from outside. Therefore, in order to apply the bias evenly and effectively a partial electroconductivity must be given on the surface of the carriers. However, carriers having a partial electroconductivity are difficult to obtain, and the high electrical resistance and the partial conductivity are incompatible by the conventional methods.

In the case that non-treated iron powders or ferrites are used as carriers the application of bias is possible, but such carriers have defects such as a lower electrical resistance and shorter life.

SUMMARY OF THE INVENTION

The object of the invention is to provide new type carriers to solve the above problems, and production thereof. The carriers according to the present invention have a higher electrical resistance, an ability to supply a stable frictional electrification, and durability.

The carrier of the present invention essentially consists of magnetic cores and polymer particles containing fine magnetic particles welded thereon; said polymer particles may contain electrical charge controlling agents.

DETAILED DESCRIPTION OF THE INVENTION

Figure 1:
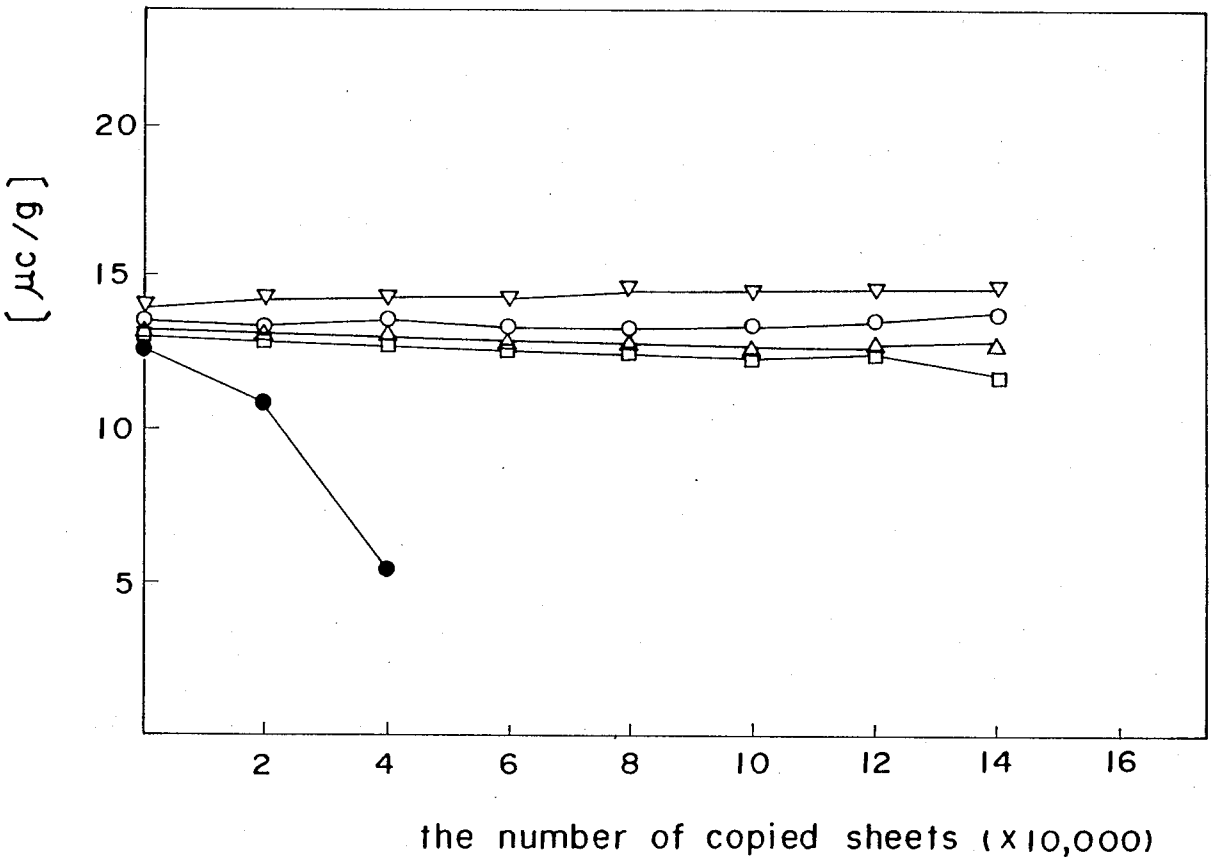
FIG. 1 shows the relation between the charge amount and the number of copied sheet.

The present invention relates to carriers for use in a developing device of an electrostatic latent image, and production thereof.

The carriers according to the present invention are essentially composed of a magnetic core and polymer particles containing fine magnetic particles; said polymer particles are welded on the magnetic core.

The magnetic core for the carriers according to the present invention includes magnetic metals, such as metals e.g., iron, nickel, cobalt; alloys containing the above metals, and other metals e.g., zinc, antimony, aluminum, lead, tin, bismuth, beryllium, manganese, selenium, tungsten, zirconium, vanadium; or mixture thereof; metal oxides such as iron oxide, titanium oxide, magnesium oxide, zinc oxide, aluminum oxide, thallium oxide, indium oxide, bismuth oxide, yttrium oxide, neodymium oxide, copper oxide, nickel oxide, titanium oxide, zirconium oxide, molybdenum oxide, vanadium oxide; metal nitride such as chromium nitride, vanadium nitride; carbides such as silicon carbide, tungsten carbide or mixture thereof; ferromagnetic substances or mixture thereof. Preferable materials used for the core of the present invention have an electrical resistance of from $10^4$ to $10^9$ Ω.cm.

The particle having a diameter of 20–200 micrometers, preferably 30–100 micrometers may be used for the core. If the core is smaller than 20 micrometers, the polymer particle layer is hardly formed on the core, because the core size is approximately the size of the polymer particles. If the core is larger than 200 micrometer, it tends toward rough copy.

According to the present invention carriers of strong magnetic intensity can be prepared even from cores of a comparatively smaller size such as 20–80 micrometer.

The polymer particles to be coated on the surface of the magnetic core contain fine magnetic particles, preferably in a homogenous dispersion.

The fine magnetic particles in the polymer particles give a partial electroconductivity to the surface of the carriers, and make excess charge, accumulated on the carrier surface through continuous copy, discharge so as to control the charge amount.

The polymer particles to be welded on the magnetic core include polymers polymerized from monofunctional monomers and/or polyfunctional monomers. The monofunctional monomers include styrene monomers such as styrene, α-methylstyrene, o-methylstyrene, m-methylstyrene, p-methylstyrene, p-ethylstyrene, 2,4-dimethylstyrene, p-n-hexylstyrene, p-n-octylstyrene, p-tert-butylstyrene, p-n-nonylstyrene, p-n-decylstyrene, p-n-dodecylstyrene, p-methoxystyrene, p-phenylstyrene and the like; acryl monomers such as methyl acrylate, ethyl acrylate, n-propyl acrylate, iso-propyl acrylate, n-butyl acrylate, iso-buty acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, diethyl phosphate ethyl acrylate, dibutyl phosphate ethyl acrylate, 2-benzoyloxyethyl acrylate and the like; methacrylate monomers such as methyl methacrylate, ethyl methacrylate, n-propyl methacrylate, iso-propyl methacrylate, n-butyl methacrylate, iso-butylmethacrylate, tert-butyl methacrylate, n-amyl methacrylate, n-ethylhexyl methacrylate, n-octyl methacrylate, n-nonyl methacrylate, diethyl phosphate ethyl methacrylate, dibutyl phosphate ethyl methacrylate and the like; methylene aliphatic monocarboxylic acid esters; vinyl esters such as vinyl acetate, vinyl propionate, vinyl benzoate, vinyl butylate, vinyl benzoate, vinyl formate; vinyl ethers such as vinyl methyl ether, vinyl ethyl ether, vinyl isobutyl ether; vinyl ketons such as vinyl methyl keton, vinyl hexyl keton, methyl isopropyl keton and the like.

As polyfunctional monomers there are exemplified diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxy diethoxy)pheny)propane, trimethylolpropane triacrylate, tetramethylolpropane tetraacrylate, ethylene glycol dimetacrylate, triethylene glycol dimetacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, polypropylene glycol dimethacrylate, 2,2'-bis(4-(methacryloxy diethoxy)phenyl)propane, 2,2'-bis(4-(methacryloxy polyethoxy)phenyl)propane, trimethylolmethane trimethacrylate, divinylbenzene, divinylnaphthalene, divinyl ether and the like.

According to the present invention homopolymers or copolymers from the above monomers may be used, for example, homopolymers from monofunctional monomers or polyfunctional monomers, or copolymers from two or more kinds of monofunctional monomers, two or more kinds of polyfunctional monomers, or the combination of monofunctional monomers and polyfunctional monomers.

These polymer particles may be prepared by any conventional polymerization technique, such as suspension polymerization, emulsion polymerization and the like, but preferable polymer particles for the present invention can be easily prepared by emulsion polymerization.

The polymer particles of the present invention may have an average diameter of about 0.6–10 micrometers, more preferably about 1.0–8 micrometers, and preferably 1/10–1/2,000 of the average diameter of the core on which the polymer particles are welded. The polymer particles of less than 0.6 micrometers are not only difficult to produce owing to agglomeration, but also difficult to provide a sufficient thickness to the welded polymer layer which provides a high electrical resistance to carriers. On other hand, particles of more than 10 micrometers make it are difficult to form a resinous particle layer on the core because of their large size.

The polymer particles to be welded on the core contain fine magnetic particles. As these fine magnetic particles the same substance as the core but smaller one, for instance, having an average diameter of about 0.01–3 micrometers, more preferably, about 0.1–1 μm may be used. The fine magnetic particles of more than 3 micrometers are disadvantageous for the adhesion of the polymer particles on the core and reduce the electrical resistance of the carriers, whereas those of less than 0.01 micrometers are inferior in dispersibility in the polymer particle because of the difficulty of grinding.

Examples of the fine magnetic particles include magnetic metals, such as metals e.g., iron, nickel, cobalt; alloys containing the above metals and other metals e.g. zinc, antimony, aluminum lead, tin, bismuth, beryllium, manganese, selenium, tungsten, zirconium, vanadium; or mixture thereof; metal oxides such as iron oxide, titanium oxide, magnesium oxide, zinc oxide, aluminum oxide, thallium oxide, indium oxide, bismuth oxide, yttrium oxide, neodymium oxide, copper oxide, nickel oxide, titanium oxide, zirconium oxide, molybdenum oxide, vanadium oxide; metal nitride such as chromium nitride, vanadium nitride; carbides such as silicon carbide, tungsten carbide or mixture thereof; ferromagnetic substances or mixture thereof. The electrical resistance of the fine particles is preferably about less than $10^{10}$ ohm.cm.

The fine magnetic particles to be contained in the polymer particles may be incorporated in a range of about 100–800, preferably about 300–700, more preferably about 400–600 parts by weight based on 100 parts by weight of the polymer particles. When using more than 800 parts by weight, the fine magnetic particles are hardly bonded by the polymer particles thus becoming brittle, and when using less than 100 parts by weight the effects from the fine magnetic particles become negligible.

The polymer particles containing the fine magnetic particles may be produced by (1) suspension, dispersion or emulsion polymerization of the monomers under the presence of the fine magnetic particles, (2) coating a resinous binder containing the fine magnetic particles on the polymer particles, (3) blending the polymeric resin for the particles and fine magnetic particles under melt state and making particles or (4) blending the polymer particles with the fine magnetic particles under such a condition that only the surface of the polymer particles is melted without the deformation thereof. As the suitable resinous binder, there are exemplified polyester resins, epoxy resins, rosin-modified phenol-formaldehyde resins, cellulose resins, polyether resins, and the like. The polymer particles containing the fine magnetic particles and having an aforementioned suitable particle size may be prepared by the spray-drying of the polymers with the magnetic particle produced by the process (1), or grinding the polymer bulk prepared by the process (1), (2) or (3). The particles obtained may be sifted to be classified to a suitable size. The polymer particles containing fine magnetic particles have a large mechanochemical effect to adhere to the core.

The polymer particles may contain electrical charge controlling agents in order to improve the clearness of the copied products. As the electrical charge controlling agents there are exemplified following negative electrical charge controlling agents and positive:

Negative electrical charge controlling agents:

Oil-Black BY (Color Indes 26150, available from Orient Kagaku Co., Ltd.), Bontron S-22 (available from Orient Kagaku K.K.), Salicylic acid metal chelate (E-81: available from Orient Kagaku K.K.), thioindigo pigments, sulfonylamine derivatives of copper phthalocyanine: Spilon Black TRH (available from Hodogaya Kagaku K.K.), Bontron S 34 (available from Orient Kagaku K.K., Nigrosine 50 (available from Orient Kagaku K.K.), Ceresschwarz (R) G (available from Farbenfabriken, Bayer A. G.), Chromogenschwartz ET 100 (I.C. No. 14645), Azo-oil Black (R) (available from National Aniline Co., Ltd.), and the like.

Positive electrical charge controlling agents:

Nigrosine Base EX (available from Orient Kagaku K.K.), Quaternary ammonium salt (P-51: available from Orient Kagaku K.K.), Nigrosine Bontron N-01 (available from Orient Kagaku K.K.), Sudantiefschwarz BB (Solvent Black 3, C.I. 26150), Fettschwarz HBN (C.I. No. 26150), Brillantspiritschwarz TN (available from Farben Fabriken Bayer A. G.), Zapanschwarz X (available from Farberke Hechist A. G.), and alkoxylated amines, alkyl amide, molybdic chelating agent and the like.

The preferable particle average diameter of the electrical charge controlling agents may be more than 0.02 micrometers, preferably 0.1 to 3 micrometers. However, larger one a e.g., 10 micrometers may be used. Such larger electrical charge controlling agents are generally agglomerates of primary particles of less than 1 micrometers, which are usually ground to the primary particles through the process of its application to the core for the carriers.

The content of the electrical charge controlling agents in the polymer particles may be about 0.1 to 20 parts by weight, preferably 0.5 to 15, more preferably 1.0 to 10 parts by weight based on 100 parts by weight of polymer particles. When constituting more than 20 parts by weight, they are insufficiently bound and become brittle, whereas when less than 0.1 parts by weight the effects therefrom are negligible.

The electrical charge controlling agents may be incorporated into the polymer particle through the similar processes (1) to (4) for the incorporation of the fine magnetic particles. The process (4) is most preferable, because the content of the electrical charge controlling agent is easily controlled.

The polymer particles may contain both the fine magnetic particles and the electrical charge controlling agents and other substances. In such a case the average diameter of the particle may be 0.6–10 micrometers, preferably 1.0–8 micrometers as aforementioned.

The polymer particles are welded on the core to form polymer layers, for which the core and the polymer particles containing the fine magnetic particles and, if desired, electrical charge controlling agents may be blended using a suitable means such as Henschel mixer to contact both, and welded at a temperature higher than the softening point of the polymer particles. Agitation and/or pressure may be applied to make the polymer particle stick more evenly and effectively. Though the means for heating, agitating and pressuring are not restricted, there are exemplified an autoclave equipped with an agitator, Spiler-Flow (available from Front Industries), an ordinary spray-dry instrument, an improver with stock equipped with heater (e.g. Nara Hybridizer available from Nara Kikai Seisakusho k.k.) as a concrete instrument for welding the polymer particles on the core.

The welding process is preferably carried out under atmosphere of inert gas such as nitrogen, argon, neon, helium, krypton, xenon and the like or vaccum in order to prevent the oxidation of the magnetic core and loss of the magnetic intensity without deterioration of mechanochemical effect of the polymer particles at the welding.

The ratio of the core to the polymer particle containing fine magnetic particles may be 100 to 0.05–50, preferably 100 to 0.1–20 by weight. If the amount of the polymer particles is less than 0.05 parts by weight, the formation of the welded layer is insufficient, and at more than 50 parts by weight excess polymer particles cannot be welded on the core, that is, free polymer exist as contaminants in obtained carriers.

The carriers coated with the polymer particles containing fine magnetic particles according to the present invention have a high electrical resistance but with a suitable conductivity. The magnetic core of the carriers is comparatively thickly coated with a nonconductive polymer layer. The polymer layer also contains fine magnetic particles which have an electroconductivity. The carriers have initially high resistivity, but before the residual potential on the carriers increases to reach the tolerance level of the electrical potential, it is leaked through the fine magnetic particles dispersed in the polymer particle layer to keep it at a suitable level.

The core coated with polymer particles containing the electrical charge controlling agent is also effective to prevent the accumulation of the excess electrical charge, and give a more clear copying image than the carriers with polymer particles not containing it.

According to the present invention the ratio of the core and the polymer particles containing the fine magnetic particles, and the electrical charge controlling agents can be easily controlled so as to give carriers having a desirable electrical resistance, for example $8\times10^{10}$–$10^{16}$ ohm.cm.

The core of the present invention may be treated with a coupling reagent in order to improve the clearness.

The coupling reagent according to the present invention includes a silane coupling reagent such as γ-glycidoxypropyltrimethylsilane, γ-(2-aminoethyl-)aminopropyltrimethylsilane, vinyltriacetoxysilane, methyltrimethoxysilane, vinyltris(methoxyethoxy)silane, γ-(2-aminoethyl)aminopropylmethyldimethoxysilane, γ-chloropropyltrimethoxysilane, (3,3,3-trifluoropropyl)methyldimethoxysilane and the like; titanate coupling reagents such as tetra(2,2-diallyloxymethyl-1-butyl)bis(ditridecyl)phosphite titanate, tetraoctylbis(ditridecylphosphite)titanate, bis(dioctyl pirophosphate oxyacetate titanate, isopropyltris(dioctyl pirophosphate) titanate and the like; aluminium coupling reagents such as acetoalkoxy aluminium diisopropionate and the like.

The treatment with the coupling reagents may be achieved by simply contacting the core with the reagents, for example, the reagents may be solved in a suitable solvent and the core may be dipped therein at room temperature or higher temperature and dried.

The present invention shall be illustrated according to the Examples hereinafter but it should not be construed to be restricted by these Examples.

EXAMPLE 1

Preparation of polymer particle I containing fine magnetic particles

| component: | parts by weight |
|---|---|
| styrene acryl copolymer (SBM-73F: available from Sanyo Kasei Kogyo K.K.) | 1000 |
| fine magnetic powder (EPT-1000, average particle diameter: 0.3–0.5 micron meter) | 1200 |

The above contents were mixed in Henschel mixer, and the obtained mixture was ground by a twin-screw-extruder. The resultant product was cooled, crudely pulverized and classified to give polymer particle I containing the fine magnetic particles, which had an average diameter of about 1.5 micrometers and an electrical resistance of $3.52\times10^{15}$ ohm.cm).

Preparation of carrier A

As a magnetic core Ferrite Carrier F-250 HR (average particle diameter of 63 micrometers, available from Nippon Teppun K.K.) was used. This core material (1000 parts by weight) was mixed with the polymer particle I (5 parts by weight) at 2000 rpm for 10 minutes in a homogenizer (available from Nippon Seiki K.K.), and then the obtained mixture was charged into an autoclave (TAS-1: available from Taiatsu Garasu Kogyo K.K.), and stirred at 700 rpm under nitrogen atmosphere (30 kg/cm$^2$) at 200° C. for 3 hours. The resultant product was sifted through a 105 micrometers-sieve to remove agglomerates to yield a carrier, which is referred to as carrier A, and had average diameter of 65 micrometers and an electrical resistance of $8.53\times10^{11}$ ohm.cm.

Determination of average diameter of carrier

The average diameter of the carrier was measured by Micro-truck Model 7995-10 SRA (available from Nikkiso K.K.).

Measurement of electrical resistance

The carrier A was put on a metallic circular electrode in 1 mm thickness and 50 mm diameter, on which the other electrode (diameter: 20 mm, and weight: 895.4 g) with a guard electrode (inner diameter: 38 mm, outer diameter: 42 mm) was put. A direct voltage of 500 V was applied between the both electrodes at a temperature of 25±1° C., and relative humidity of 55±5%, and the electrical resistance was determined after one minute, which was converted into a volumetric resistivity ($\rho$). The result was expressed by the average value of five determinations.

Copying durability test

In a polyethylene vessel (1 liter) 480 g of carrier A and 20 g of the toner described hereinafter was taken, and mixed in a ball mill for 5 hours. Using the mixture obtained 140,000 sheets of paper were copied by the Copying Machine EP-470Z (available from Minolta Camera K.K.). The relation of the amount of electrical charge on the toner (ordinate) and the number of copied sheets (abscissa) is shown in FIG. 1. In FIG. 1, the plot (A) represents the amount of the electrical charges on the toner using the carrier A.

Preparation of toner

| Formulation: | parts by weight |
|---|---|
| styrene-acryl resin (softening point: 132° C., Tg: 62° C.) | 100 |
| carbon black MA #8 (available from Mitsubishi Kasei Kogyo K.K.) | 5 |
| electrical charge controlling agent (Nigrosine Base EK, available from Orient Kagaku K.K.) | 5 |

The above components were sufficiently mixed by a Henschel mixer. The mixture was ground by a twin-screw-extruder, cooled and pulverized. The resultant product was classified by a jet pulverizer and an air-classifying device to yield a positive insulated toner having a diameter of 13.2 micrometers.

Determination of average diameter of toner

The average diameter of the toner was measured by a Coulter Counter II (available from Coulter Counter Co., Ltd.), which was expressed as a relative weight distribution to a particle diameter determined through an aperture tube of 100 micrometers.

EXAMPLE 2

Carrier B was prepared in the same manner as in Example 1 except that 1000 parts by weight of Ferrite Carrier F-250 (average diameter: 44 micrometers, available from Nippon Teppun K.K.) as a core material, and 20 parts by weight of the polymer particles I prepared in Example 1 were used. The obtained carriers had an average diameter of 46 micrometers and an electrical resistance of $7.25\times10^{14}$ ohm.cm.

The average diameter of the carrier B, the electrical resistance and the copying durability test were determined according to the manner as described in Example 1. The result is shown in FIG. 1 by the plot (B).

EXAMPLE 3

Polymer particle II containing fine magnetic particles was prepared in the same manner as in Example 1 except that 100 parts by weight of polyester resin (NE-4; available from Kao K.K.) as a polymer particle and 600 parts by weight of Ferrite MFP-2 (average diameter: 0.5 micrometers, available from TDK) as fine magnetic particles were used. The obtained particle II had an average diameter of 2.3 micrometers and an electrical resistance of $8.25\times10^{13}$ ohm.cm).

Carrier C was prepared according to a similar manner to Example 1 except that 1000 parts by weight of Ferrite Carrier F-250 HR (average diameter: 63 micrometers) as a core material and 30 parts by weight of the polymer particles II prepared in the above were used to give carrier B, which had an average diameter of 66 micrometers and an electrical resistance of $6.53\times10^{12}$ ohm.cm.

The average diameter of the carrier C, the electrical resistance and the copying durability test were determined according to the same manner as described in Example 1. The result is shown in FIG. 1 by the plot (C).

EXAMPLE 4

Carrier D was prepared in the same manner as in Example 1 except that 1000 parts by weight of Ferrite Carrier F-250 HR (average diameter: 44 microns, available from Nippon Teppun K.K.) as a core material and 20 parts by weight of the polymer particle II in Example 3 was used. The obtained carrier D had an average diameter of 46 micrometers, and an electrical resistance of $8.95\times10^{11}$ ohm.cm.

The average diameter of the carrier D, the electrical resistance and the copying durability test were determined according to the manner as described in Example 1. The result is shown in FIG. 1 by the plot (D).

COMPARATIVE EXAMPLE 1

As carriers Ferrite Carrier F-250HR (average diameter: 63 micrometer, electrical resistance: $7.25\times10^{6}$ ohm.cm, available from Nippon Teppun K.K.) itself was used, which was named as carrier c-1.

The average diameter of the carrier c-1, the electrical resistance and the copying durability were determined according to the manner as described in Example 1. The result is shown in FIG. 1 by the plot c-1.

Results

In the durability test stable copied images were obtained from the carriers of Examples 1–4, whereas from the carriers of Comparative Example 1 the density of copied images were decreased to lead to unclear copy and toner scattering.

EXAMPLE 5

Preparation of polymer particles III–IX containing fine magnetic particles:

Polymer particle III

| components: | parts by weight |
|---|---|
| Ferrite Carrier MFP-2 (average diameter: 0.5 micrometers, available form TDK K.K.) | 100 |
| bisphenol type polyester resin (softening point: 123° C., Tg: 65° C., AV: 21, OHV: 43, Mn: 7,600, Mw: 188,400) | 30 |

The above components were homogenously mixed in 10 liter Henschel mixer, and ground by a twin-screw-extruder. The resultant product was cooled, roughly smashed, finely pulverized by a hummer mill, and then classified by an air classifying device to give the polymer particle III containing fine magnetic particles, the average diameter of which was 3.5 micrometers.

Polymer particle IV

| components: | parts by weight |
|---|---|
| Magnetic Particle EPT-1,000 (average diameter: 0.3–0.5 micrometers, available from Toda Kogyo K.K.) | 100 |
| styrene-acryl copolymer SMB-73F | 40 |

-continued

| components: | parts by weight |
|---|---|
| (available from Sanyo Kasei Kogyo K.K.) | |

The above components were used to prepare the polymer particle IV of average diameter of 3 micrometers according to a similar manner to the preparation of the polymer particle III.

Polymer particle V

| components: | parts by weight |
|---|---|
| Ferrite MFP-2 (average diameter: 0.5 micrometers, available from TDK K.K) | 100 |
| styrene-acryl copolymer SBM-73F | 50 |

The above components were used to prepare the polymer particle V (average diameter: 2 micrometers) according to a similar manner to the preparation of the polymer particle III

Polymer particle VI

| components: | parts by weight |
|---|---|
| Ferrite EPT-1000 (average diameter: 7.3–0.5 micrometers, available from Toda Kogyo K.K.) | 100 |
| bisphenol type polyester resin | 35 |

The above components were used to prepare the polymer particle VI (average diameter: 4.5 micrometers) according to a similar manner to the preparation of the polymer particle III.

Polymer particle VII

| components: | parts by weight |
|---|---|
| Ferrite EPT-500 (available from Toda Kogyo K.K.) | 100 |
| styrene-n-butyl methacrylate resin (softening point: 132° C., Tg: 60° C.) | 50 |

The above components were used to prepare the polymer particle VII (average diameter: 4 micrometers) according to a similar manner to the preparation of the polymer particle III.

Polymer particle VIII

| components: | parts by weight |
|---|---|
| Magnetite Spiroblack BL-SP (available from Titan Kogyo K.K.) | 100 |
| styrene resin (Hymer SB75: available from Sanyo Kasei Kogyo K.K.) | 25 |

The above components were used to prepare the polymer particle VIII (average diameter: 5 micrometers) according to a similar manner to the preparation of the polymer particle III.

Polymer particle IX

| components: | parts by weight |
|---|---|
| Ferrite EPT-500 (available from Toda Kogyo K.K.) | 100 |

-continued

| components: | parts by weight |
|---|---|
| epoxy resin (EP-13: available from Toray K.K.) | 50 |

The above components were used to prepare the polymer particle IX (average diameter: 2 micrometers) according to a similar manner to the preparation of the polymer particle III.

Preparation of carrier E–P

Preparation of carrier E

As a core Ferrite Carrier FMC-60 (average diameter: 44 micrometers, electrical resistance: $2.8\times10^9$ ohm.cm., available from TDK K.K.) 100 parts by weight was used, and the polymer particle III, 20 parts by weight, were mixed therewith by a Henschel mixer (10 liter) at 2,000 rpm to make the polymer particle III evenly adhere around the core. The resultant particles were individually dispersed in an air flow heated to 320° C., in which the particles were heated for about 1–3 seconds to be melted on the surface alone, by which the particle III was welded on the surface of the core to give the carrier E'.

Around the carrier E' 100 parts by weight, a positive electrical charge controlling agent (an electrical charge controlling agent is referred to as CCA hereinafter), Nigrosine Base EX 2 parts by weight, was coated in a similar manner as described above to yield carrier E having an average diameter of 49 micrometers.

Preparation of carrier F

The Ferrite Carrier FMC-60 was used as a core material. The core material, 100 parts by weight, and the polymer particle V, 15 parts by weight, were mixed at 2,000 rpm for 10 minutes in a homogenizer (available from Nippon Seiki K.K.), and then blended at 200° C. and 700 rpm for 3 hours under a nitrogen atmosphere (30 kg/cm$^2$) in an autoclave with stirrer (TAC-1: available from Taiatsu glass Kogyo K.K.) to make the polymer particle V weld around the surface of the core material to yield carrier F'. On the surface of the carrier F' 100 parts by weight of a positive CCA, salicylic acid metal chelate (E-81: available from Orient Kagaku K.K.), 3 parts by weight was coated in a manner similar to the preparation of the carrier E to yield the carrier F having an average particle size of 50 micrometers.

Preparation of carriers G–K

The carriers G–K were prepared according to the preparation of the carrier E, but as a core, a polymer particle and CCA including the following materials were used:

Carrier G polymer particle IV,
core: Ferrite Carrier F 141-3040 (available from Nippon Teppun K.K., average diameter: 53.2 micrometers, resistance: $3.8\times10^8$ ohm.cm)
CCA: Nigrosine Bontron N-01 (available from Orient Kagaku K.K.)

Carrier H polymer particle IX,
core: Ferrite Carrier F 141-3040,
CCA: Fettschwarz HBN (I.C. No. 26150), Carrier I polymer particle VI,
core: iron powder (TEFV 250/400, available from Nippon Teppun K.K., average diameter: 50 micrometers, resistance: $3.2\times10^6$ ohm.cm.),
CCA: Nigrosine Base EX, Carrier J polymer particle V,
core: iron powder (TEFV 250/400)
CCA: quaternary ammonium salt (P-51: available from Orient Kagaku K.K.), Carrier K polymer particle III,
core: Ferrite Carrier F 99-3040 (available from Nippon Teppun K.K., average diameter: 50 micrometers, resistance: $1.9\times10^9$ ohm.cm.)
CCA: Sudantiefschwarz BB (Solvent Black 3; C.I. No. 26,150)

Preparation of carriers L–P

The carriers L–P were prepared according to a manner similar to the preparation of carrier F except that as a core, a polymer particle and a CCA including the following materials were used.

Carrier L polymer particle VII,
core: Ferrite Carrier F 99-3040,
CCA: Fettschwarz HBN (C.I. No. 26,150)

Carrier M polymer particle VIII,
core: Ferrite Carrier F 99-3040,
CCA: quaternary ammonium salt (P-51), Carrier N polymer particle IV,
core: Ferrite Carrier F 95-3040 (available from Nippon Teppun K.K., average diameter: 50 micrometers, resistance: $6.9\times10^8$ ohm.cm.), Carrier O polymer particle VII,
core: Ferrite Carrier F 95-3040,
CCA: nigrosine (Base EX), Carrier P polymer particle VI,
core: Ferrite Carrier F 182-2540 (available from Nippon Teppun K.K., average diameter: 50 micrometers, resistance: $1.5\times10^7$ ohm.cm),
CCA: nigrosine (Bontron N-01: available from Orient Kagaku K.K.)

The electrical resistance, the average diameter of the toner and carriers were also determined in the same manner as in Example 1.

Evaluation of durability against copy

Preparation of toner

Negative toner

| components: | parts by weight |
|---|---|
| polyester resin (softening point: | 100 |

-continued

| components: | parts by weight |
|---|---|
| 130° C., Tg: 60° C.) | |
| carbon black (MA #8: available from Mitsubishi Kasei K.K.) | 5 |

The above components were mixed in a ball mill, and then blended by a three-roll mill at 140° C. After the mixture cooled, the blended mixture was roughly smashed, and finely pulverized by a jet mill. The products were classified by an air classificater to give a negative toner having an average diameter of 13 micrometers.

Positive toner

| components: | parts by weight |
|---|---|
| styrene-n-butyl methacrylate resin (softening point: 132° C., Tg: 60° C.) | 100 |
| carbon black (MA #8: available from Mitsubishi Kasei K.K.) | 5 |
| nigrosine dye (Bontron N-01: available from Orient Kagaku K.K.) | 3 |

The positive toner was prepared in the same manner as in the preparation of negative toner except that as a toner the just above components are used.

Durability and frictional chargeability at use of negative toner

The negative toner (48 g) as prepared in the above and carriers (552 g) were taken in a 1 liter polyethylene vessel, which were rotated for 5 hours to be mixed. Using the above mixture 50,000 sheets of paper were copied by the copying machine, EP-870 (available from Minolta Camera K.K.) equipped with a sleeve rotating developer to evaluate the clearness of the copied image on the paper.

Durability and frictional chargeability at use of positive toner

The positive toner (50 g) as prepared in the above and carriers (450 g) were taken in a 1 liter polyethylene vessel, which were rotated for 5 hours to be mixed. Using the above mixture 50,000 sheets of paper were copied by the copying machine, EP-470Z (available from Minolta Camera K.K.) equipped with a sleeve rotating developer to evaluate the clearness of the copied image on the paper.

Evaluation

The *frictional chargeability* of the above mixture was determined when 1,000, 5,000, 10,000, 30,000 and 50,000 sheets of paper were copied.

The durability was evaluated by the observation of clearness of copied image on 50,000th sheet.

E: excellent, no fog,
G: good, few fog,
I: inferior, a few fog but practicable,
B: bad, many fogs and impracticable.
The results are shown in Table 1.

Determination of frictional chargeability II

The carrier E (90 parts by weight) was homogenously mixed with the above negative toner and positive toner (10 parts by weight) individually to prepare two kinds of developer. Each developer (30 g) was taken into a polyethylene bottle (50 cc), and stirred at 120 rpm to generate a frictional charge. The change amount on the toner with time is determined at initial, 3 minutes, and 10 minutes stirring. The results were shown in FIG. 2, wherein the charge amount (μC/g and the time are shown on ordinate and abscissa respectively, and the plot n-E represents the combination of the carrier E and the negative toner, and the plot p-E represents the combination of the carrier E and the positive toner.

Figure 2:
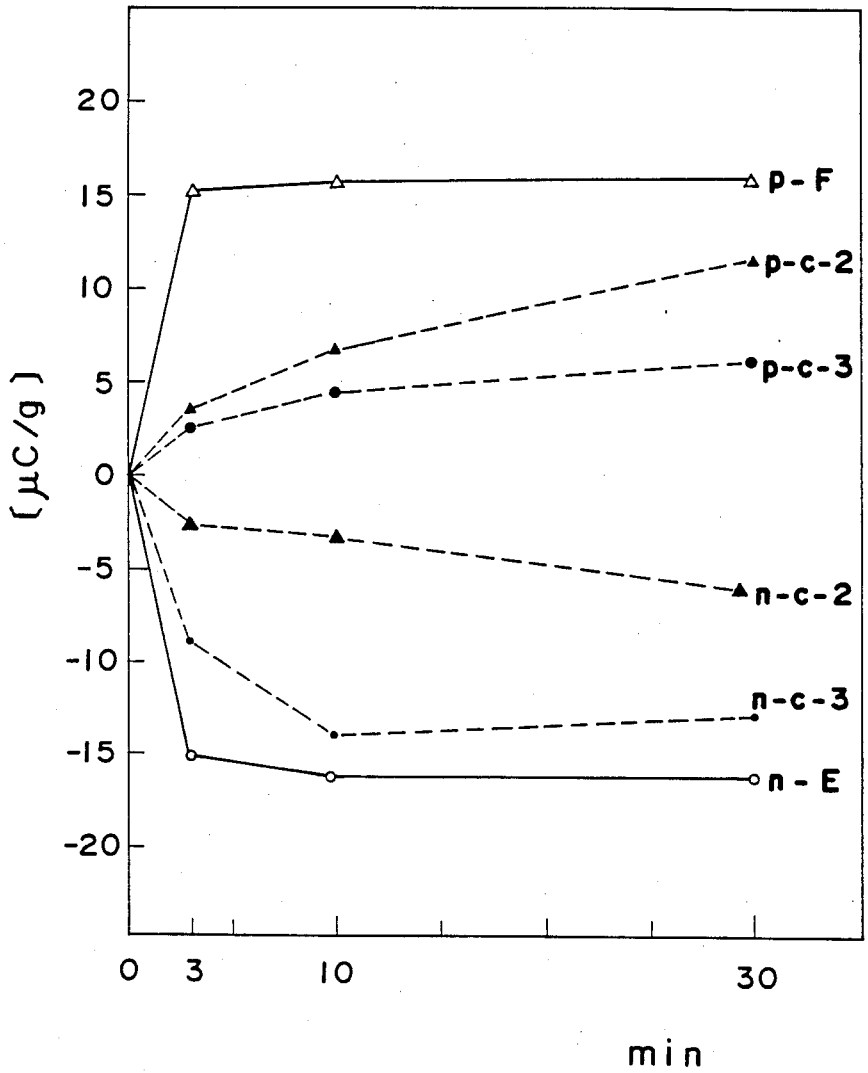
FIG. 2 shows the change of the charge amount on toners with time when developers containing the toners and carriers are stirred.

In the similar manner to the above a frictional chargeabilities of the developer containing the carrier F were determined. The results are shown in FIG. 2 as the plot n-F and the plot p-F.

COMPARATIVE EXAMPLE 2

Preparation of resin coated carrier c-2

| components: | parts by weight |
|---|---|
| bisphenol type polyester resin (softening point: 123° C., Tg: 65° C., AV: 21, OHV: 43, Mn: 7,600, Mw: 188,400) | 40 |
| Nigrosine Base EX | 5 |

The above components were homogenously ground with toluene under high shearing force, to which 500 parts by weight of Ferrite Carrier FMC-6C were added. The mixture obtained was spray-dried to give a resin coated carrier of an average diameter of 48 micrometers, which are referred to as carrier c-2.

Preparation of resin coated carrier c-3

| components: | parts by weight |
|---|---|
| styrene acryl resin (SBM-73F: available from Sanyokasei Kogyo K.K.) | 50 |
| Spilon Black TRH (available from Hodogaya Kagaku K.K.) | 10 |

The above components were homogeneously ground with toluene under high shearing force, to which 500 parts by weight of iron carriers (TEFV 250/400) were added. The mixture obtained was spray-dried to give a resin coated carrier of an average diameter of 52 micrometers (thickness of coated layer: 1 micrometers), which are referred to as carrier c-3.

Using the negative toner or the positive toner as prepared in the Example 5, the durability and the frictional chargeability of the mixture of the carriers c-2 or c-3 and each toner were evaluated in the same manner as in Example 5. The results were shown in Table 1.

Determination of frictional chargeability

Developers individually containing carriers c-2, and c-3 with the negative or positive toner were prepared, and the frictional chargeabilities were determined in a similar manner to the Example 5. The results were shown in FIG. 2. The plots n-c-2, p-c-2, n-c-3, and p-c-3 represent the combination of the toner and the carrier according to the nomination as in Example 5.

FIG. 2 shows that the charge amount of the developer containing the carrier E or F increases to come up to a desirable level as soon as the stirring was started but did not exceed the desirable level even for a longer stirring. From the results it is shown that the carrier of the present invention has a high electrical resistance due to the insulating polymer particle layer, but when an excess charge amount is accumulated on the toner the fine magnetic particles in the polymer particles on the core act as an electrically conductive material to dischargethe excess charge and control the charge amount on the toner at a suitable level.

On the other hand, the charge amount on the toner in the developer containing the carriers c-2 and c-3 shows poor increase of charge amount at the start, and lower maximum resistance.

TABLE 1

| carrier | | | electrical | durability | | | | | | |
|---|---|---|---|---|---|---|---|---|---|---|
| | diameter | | resistance × | | chargeability (μC/g) | | | | | |
| No. | (μm) | toner | $10^{10}$ Ωcm | initial | 1000 | 5000 | 10000 | 30000 | 50000 | clearness |
| E | 49 | (−) | 7.1 | −17.2 | −16.8 | −17.3 | −17.0 | −17.1 | −17.5 | E |
| F | 50 | (+) | 12 | 16.1 | 16.3 | 15.9 | 16.2 | 15.3 | 16.0 | E |
| G | 60 | (−) | 9.1 | −12.3 | −13.0 | −13.1 | −12.9 | −13.8 | −13.3 | E |
| H | 58 | (+) | 20 | 17.1 | 17.8 | 17.7 | 17.9 | 17.6 | 18.0 | E |
| I | 57 | (+) | 85 | 11.3 | 11.5 | 12.1 | 11.6 | 11.9 | 12.5 | E |
| J | 56 | (−) | 92 | −11.1 | −11.0 | −11.5 | −12.0 | −11.3 | −11.7 | E |
| K | 55 | (−) | 110 | −14.1 | −15.0 | −14.8 | −14.5 | −14.3 | −15.0 | E |
| L | 59 | (−) | 80 | −10.3 | −11.0 | −11.1 | −11.9 | −12.1 | −11.5 | E |
| M | 58 | (+) | 95 | 15.3 | 15.9 | 15.7 | 15.9 | 16.0. | 16.2 | E |
| N | 57 | (+) | 230 | 15.0 | 14.7 | 15.1 | 14.9 | 15.3 | 15.5 | E |
| O | 59 | (−) | 110 | −14.0 | −14.2 | −14.5 | −14.8 | −14.6 | −14.3 | E |
| P | 57 | (+) | 87 | 18.0 | 18.3 | 17.9 | 18.5 | 17.8 | 17.9 | E |
| c-2 | 48 | (−) | 0.23 | −5.9 | −3.9 | −4.3 | −4.6 | −5.0 | −4.1 | B |
| c-3 | 52 | (−) | 6.31 | −8.3 | −8.9 | −8.1 | −7.9 | −8.0 | −8.5 | B |
| | | (+) | | 7.1 | 6.8 | 7.0 | 7.5 | 6.3 | 6.5 | B |

EXAMPLE 6

Preparation of polymer particles X-XVI containing fine magnetic particles and CCA

Polymer particle X

| components: | parts by weight |
|---|---|
| Ferrite MFP-2 (average diameter: 0.5 micrometer | 100 |
| bisphenol type polyester resin (softening point: 123° C., Tg: 65° C., AV: 21, OHV: 43, Mn: 7,600, Mw: 188,400) | 30 |
| Nigrosine Base EX | 5 |

The above components were mixed in 10 liter Henschel mixer, and then blended by a twin-screw extruder. The blended mixture was cooled, roughly smashed, and then finely pulverized by a jet pulverizer. The obtained particles were classified to the average diameter of 3.5 micrometers by an air classificater to yield the polymer particle X.

Polymer particle XI

| components: | parts by weight |
|---|---|
| Ferrite MFP-2 | 100 |
| bisphenol type polyester resin (the same as in particle X) | 40 |
| salicylic acid metal chelate (E-81: available from Orient Kagaku K.K.) | 5 |

The polymer particle XI was prepared in the same manner as in the preparation of polymer particle X except that the above components were used. The average diameter of the obtained polymer particle XI is 3 micrometers.

Polymer particle XII

| components: | parts by weight |
|---|---|
| Ferrite EPT-1000 | 100 |
| styrene-acryl copolymer (SBM-73F | 25 |
| quaternary ammonium salts (P-51) | 5 |

The polymer particle XII was prepared in the same manner as in the preparation of polymer particle X except that the above components were used. The average diameter of the polymer particle XII is 5 micrometers.

Polymer particle XIII

| components: | parts by weight |
|---|---|
| Ferrite EPT-1000 | 100 |
| styrene-acryl copolymer (SBM-73F) | 35 |
| Spyron Black TRH | 10 |

The polymer particle XIII was prepared in the same manner as in the preparation of polymer particle X except that the above components were used, the average diameter of which was 4 micrometers.

Polymer particle XIV

| components: | parts by weight |
|---|---|
| Ferrite EPT-500 | 100 |
| styrene-n-butyl methacrylate (softening point: 132° C., Tg: 60° C.) | 45 |
| Nigrosine Bontron N-01 | 5 |

The polymer particle XIV was prepared in the same manner as in the preparation of polymer particle X except that the above components were used, the average diameter of which was 3 micrometers.

Polymer particle XV

| components: | parts by weight |
|---|---|
| Magnetite Spico Black BL-SP | 100 |
| epoxy resin (EP-13: available from Toray K.K.) | 40 |
| Bontron S-22 (available from Orient Kagaku K.K.) | 3 |

The polymer particle XV was prepared in the same manner as in the preparation of polymer particle X except that the above components were used, the average diameter of which was 3 micrometers.

Polymer particle XVI

| components: | parts by weight |
|---|---|
| Magnetite Spico Black BL-SP | 100 |
| styrene resin (Hymer SB75: available from Sanyo Kasei Kogyo K.K.) | 50 |
| Oil Black BY (available from Orient Kagaku K.K.) | 10 |

The polymer particle XVI was prepared in the same manner as in the preparation of polymer particle X except that the above components were used, the average diameter of which was 4 micrometers.

Preparation of carriers Q-ZZ

Carrier Q

Ferrite Carrier FMC-6C (as core materials) 100 parts by weight and the polymer particle X 20 parts by weight were mixed at 2,000 rpm for 2 minutes in a Henschel mixer (10 liter) to evenly coat the polymer particle X on the core. The coated core was individually dispersed in an air flow heated at 320° C. for about 1-3 seconds to weld the polymer particle on the core surface alone to give the carrier Q having an average diameter of 48 micrometers.

Carrier R

Ferrite Carrier F 141-3040 (average diameter of 53.2 micrometers, electrical resistance $3.8\times10^8$ ohm.cm, available from Nippon Teppun K.K.) 100 parts by weight and the polymer particle XII 25 parts by weight were mixed at 2,000 rpm for 10 minutes in a homogenizer (available from Nippon Seiki K.K.). The mixture was charged into an autoclave (TAS-1: available from Taiatsu Glass K.K.) and was stirred at 700 rpm, at 200° C. under an atmosphere of nitrogen of 30 kg/cm$^2$ for 3 hours. Coagulants in the mixture were removed through a 105 micron-sieve to give the carrier R having an average diameter of 55 micrometers.

Carriers S-W

The carriers S-W were prepared in the same manner as in the preparation of carrier Q except that the following components were used.

Carrier S polymer particle XIII,
core: Ferrite Carrier FMC-6C,

Carrier T:

polymer particle XV,
core: Ferrite Carrier FMC-6C,

Carrier U polymer particle XIV,
core: Ferrite Carrier F 141-3040,

Carrier V polymer particle XI,
core: Iron Powder TEFV 250/400,

Carrier W polymer particle XIII,
core: Iron Powder TEFV 250/400.

carriers X-ZZ

The carriers X-ZZ were prepared in the same manner as in the preparation of carrier R except that the following components were used.

Carrier X polymer particle XVI,
core: Ferrite Carrier F 99-3040,

Carrier Y polymer particle XII,
core: Territe Carrier F 95-3040

Carrier YY polymer particle XVI
core: Ferrite Carrier F 95-3040,

Carrier Z polymer particle X
core: Ferrite Carrier F 182-2540 (average diameter: 50 micrometers, electrical resistance: $1.5\times10^7$ ohm.cm, available from Nippon Teppun K.K.)

Carrier ZZ polymer particle XV
core: Ferrite Carrier F 182-2540.

Evaluation of frictional chargeability and durability against copy

Figure 3:
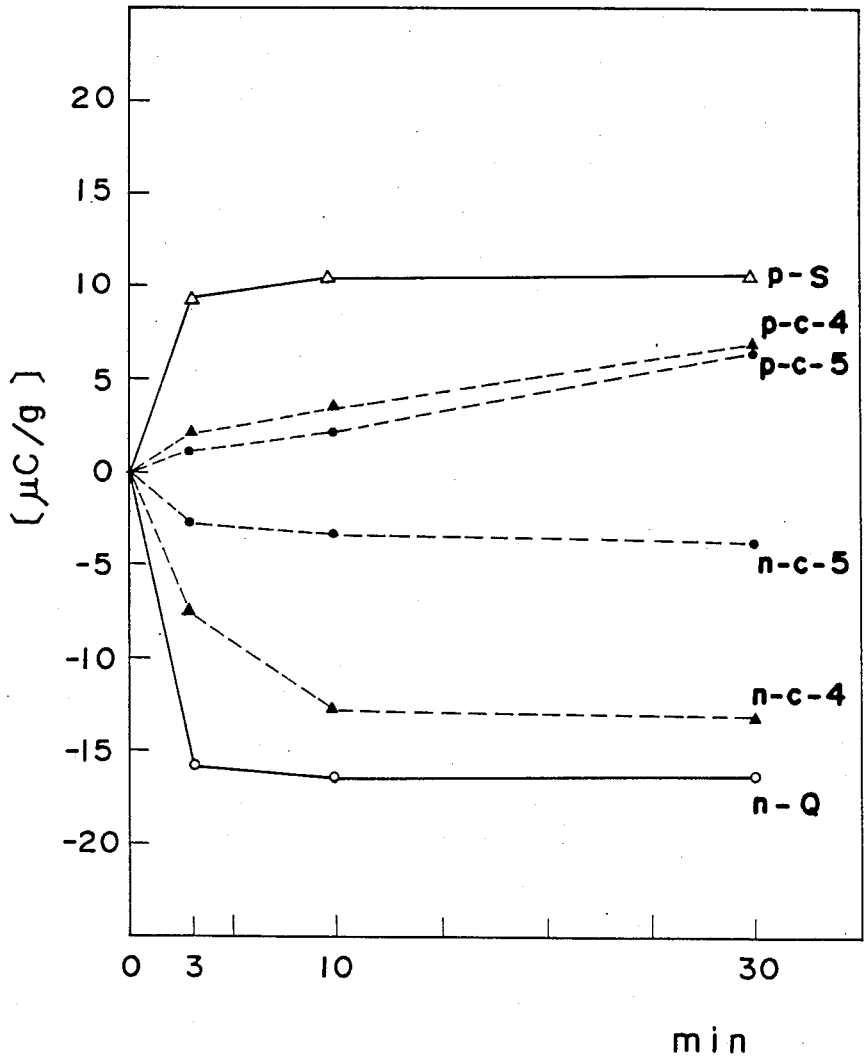
FIG. 3 shows the change of the charge amount on toners with time when developers containing the toners and carriers are stirred.

The evaluation was made in the same manner as in Example 5 except that the different carriers were used. The results were shown in Table 2 and FIG. 3. In FIG. 3 the marks n-Q, p-Q, n-S, and p-S represent the combination of the toner and the carrier respectively in the same manner as in Example 5.

COMPARATIVE EXAMPLE 3

Preparation of carriers

Carrier c-4

Ferrite Carrier F-250 HR (available from Nippon Seifun K.K., average diameter: 50 micrometers, electrical resistance $3.50\times10^7$ ohm.cm) was used as a carrier (referred to as carrier c-4).

Carrier c-5

Ferrite Carrier F 99-3041 (available from Nippon Teppun K.K., average diameter: 52 micriometes, electrical resistance $1.40\times10^{10}$ ohm.cm) was coated with silicone resin to give carrier c-5.

Carrier c-6

A polyester resin (Tafuton NE 1110: available from Kao K.K.) was homogeneously dispersed in toluene under high shearing power, to which Ferrite Carrier F-250 HR ($3.5\times10^7$ ohm.cm) was added. The mixture was spray-dried to give carrier c-6 coated with polyester resin thereon, which has an average diameter of 53 micron meter, and an electrical resistance of $1.85\times10^{12}$ ohm.cm.

Carrier c-7

| components: | parts by weight |
|---|---|
| bisphenol type polyester resin (softening point: 123° C., Tg: 65° C., AV. 21, OHV 43, Mn: 7,600, Mw: 188,400) | 40 |
| Nigrosine Base EX | 5 |

The above components were homogeneously dispersed in toluene under high shearing condition, to which Ferrite carrier FMC-6C was added, and spray-dried to give a surface coated carrier (referred to as carrier c-7) having an average diameter of 50 micrometers and an electrical resistance of $6.91\times10^{11}$ ohm.cm.

Evaluation of frictional chargeability and durability against copy

The evaluation was made according to the manner described in Example 5. The results were shown in Table 2 and FIG. 3. In FIG. 3, the plots n-c-4, p-c-4, n-c-5 and p-c-5 represent the combination of the toner and the corresponding carrier in the same manner as in Example 5.

TABLE 2

| carrier | | | electrical | durability | | | | | | |
|---|---|---|---|---|---|---|---|---|---|---|
| | diameter | | resistance × | | chargeability (μC/g) | | | | | |
| No. | (μm) | toner | $10^{10}$ Ωcm | initial | 1000 | 5000 | 10000 | 30000 | 50000 | clearness |
| Q | 48 | (−) | 5.5 | −17.1 | −17.5 | −17.6 | −18.3 | −18.1 | −18.2 | E |
| R | 55 | (−) | 4.5 | −16.2 | −15.8 | −15.6 | −15.2 | −16.0 | −15.8 | E |
| S | 49 | (+) | 6.0 | 10.9 | 11.2 | 12.2 | 12.0 | 12.3 | 12.5 | E |
| T | 50 | (+) | 5.0 | 13.8 | 14.1 | 14.5 | 14.6 | 14.0 | 14.3 | E |
| U | 60 | (−) | 62 | −17.3 | −16.2 | −16.3 | −15.8 | −16.0 | −15.9 | E |
| V | 56 | (−) | 7.0 | −13.6 | −13.2 | −13.8 | −13.9 | −14.0 | −14.2 | E |
| W | 55 | (+) | 41 | 10.3 | 10.5 | 11.2 | 11.0 | 10.8 | 11.3 | E |
| X | 58 | (−) | 21 | −7.3 | −8.0 | −9.1 | −9.3 | −9.3 | −9.4 | E |
| Y | 56 | (−) | 130 | −10.6 | −9.5 | −9.7 | −10.6 | −12.3 | −12.1 | E |
| X | 59 | (+) | 98 | 12.1 | 11.8 | 12.3 | 12.2 | 12.7 | 12.8 | E |
| YY | 54 | (−) | 220 | −12.1 | −13.0 | −12.8 | −12.5 | −12.7 | −13.0 | E |
| ZZ | 57 | (+) | 300 | 17.0 | 16.8 | 17.3 | 17.2 | 17.0 | 17.4 | E |
| c-4 | 50 | (+) | 0.0035 | 5.7 | 5.8 | 4.9 | 4.5 | 4.0 | 3.8 | B |
| | | (−) | | −15.0 | −14.2 | −13.4 | −12.2 | −9.8 | −8.6 | I-B |
| c-5 | 52 | (+) | 1.4 | 6.0 | 6.3 | 6.0 | 5.8 | 5.9 | 6.1 | B |
| | | (−) | | −5.3 | −5.6 | −5.5 | −5.0 | −5.1 | −5.5 | B |
| c-6 | 53 | (+) | 185 | 12.3 | 12.1 | 12.7 | 13.5 | 14.8 | 17.9 | G |
| | | (−) | | −3.2 | −3.3 | | | | | B |
| c-7 | 50 | (+) | 69 | 3.9 | 4.3 | 4.4 | 4.7 | 4.5 | 5.0 | B |
| | | (−) | | −6.9 | −7.3 | −7.9 | −6.9 | −7.5 | −7.7 | B |

EXAMPLE 7

Preparation of cores (a)–(f)

Core (a)

As the core (a) an iron carrier (TEFV 250/400: available from Nippon Teppun K.K., average diameter: 50 micrometers, true specific gravity: 7.6) was used as is.

Core (b)

Magnetites prepared by a wet method (average size: 0.6 micrometers, cubic) was dispersed in a polyvinyl alcohol solution by a ball mill to prepare a magnetite slurry. The slurry was spray-dried to give spherical particles of 30–80 micrometers. The particles were sintered at 1,000° C. for 3 hours under a nitrogen atmosphere, cooled and sifted through sieves of 250 mesh and 400 mesh to yield a spherical core of an average diameter of 52 micrometers, which is referred to as core (b) hereinafter.

Core (c)

An iron alloy wire consisting of silicon, one part by weight, manganese, 3 percent by weight, and iron, 96 parts by weight, was set on a conventional electrical wire gun, through which a high electrical current was passed to melt the wire, and simultaneously the melted wire was sprayed with a high pressure nitrogen gas. The obtained particle was atomized to give iron particles. The particles were classified to 50 micrometers by an air-class classification. The obtained particle was substantially spherical, and referred to as core (c) hereinafter.

Core (d)

As the core (d) Ferrite Carrier FMC-6 (5E 062) (available from TDK K.K., average diameter: 36 micrometers) was used without any modification.

Core (e)

As the core (e) Ferrite Carrier F-250 HR (85-F 965: available from Nippon Teppun K.K.) was used as is.

Core (f)

As the core (f) a fluoroplastic coated ferrite carrier (KG-200: available from Kanto Denka K.K., average diameter of 45 micrometers) was used without any modifications.

Coupling reagents

Following coupling reagents were used for the treatment of the surface of the above cores:

Coupling reagent (1)

γ-glycidoxypropyltrimethylsilane (Toray Silicone SH 6040, available from Toray Silinone K.K.), Coupling reagent (2)

γ-(2-aminoethyl)aminopropyltrimethylsilane (Toray Silicone SH 6020, available from Toray Silicone K.K.), Coupling reagent (3)

vinyltriacetoxysilane (Toray Silicone SH 6075: available from Toray K.K.),

Coupling reagent (4)

Methyltrimethoxysilane (Toray Silicone SZ 6070: available from Toray Silicone K.K.), Coupling reagent (5)

vinyltris(methoxyethoxy)silane (Toray Silicone SH 6082: available from Toray Silicone K.K.), Coupling reagent (6)

γ-(2-aminoethyl)aminopropylmethyldimethoxysilane,

Coupling reagent (7)

γ-chloropropyltrimethoxysilane,

Coupling reagent (8)

(3,3,3-trifluoropropyl)methyldimethoxysilane,

Coupling reagent (9)

Tetra(2,2-diallyloxymethyl-1-butyl)bis(ditridecyl) phosphite titanate (KR-55: available from Ajinomoto K.K.), Coupling reagent (10)

Tetraoctylbis(ditridecylphosphite) titanate (KR-46B: available from Ajinomoto K.K.), Coupling reagent (11)

Bis(dioctyl pirophosphate oxyacetate titanate (KR-1385: available from Ajinomoto K.K.), Coupling reagent (12)

Isopropyltris(dioctyl pirophosphate) titanate (KR-38S: available from Ajinomoto K.K.), Coupling reagent (13)

Bis(perfluoro acetic acid) zirconium dimethoxide, and

Coupling reagent (14)

Acetoalkoxy aluminium diisopropionate (AL-M: available from Ajinomoto K.K.).

Treatment of the cores (a)-(f) with the coupling reagents

The above cores (a)-(f) were treated with the coupling reagents (1)-(14) by the following method, in which the combinations of the both are shown in Table 3.

The coupling reagent, 6 g, was solved in an ethyl alcohol/water (1:1) solution, 500 ml, into which the core, 200 g, was added and stirred at 80° C. for one hour, and then the mixture was filtered under a vacuum to collect the coated core. The obtained coated core was warmed at 50° C. on a temperature controlled bath for 5 hours, and then dried for 24 hours under vacuum in a silica gel desiccator to give a core treated with the coupling reagent, which is referred to as coupling-cores (a)-(f) corresponding to the above cores (a)-(f) respectively.

Preparation of polymer particles XVII-XXIV containing fine magnetic particles and electrical charge controlling agents Particle XVII

| components: | parts by weight |
|---|---|
| Ferrite MFP-2 | 100 |
| bisphenol type polyester resin (softening point: 123° C., Tg: 65° C. AV: 21, OHV: 43, Mn: 7,600, Mw: 188,400) | 50 |
| Nigrosine Base EX | 5 |

The above components were sufficiently mixed in 10 liter Henschel mixer, and then blended by a twin-screw-extruder. The mixture was cooled, roughly smashed and then finely pulverized by a hummer mill. The obtained powder was classified by an air-classificator to give polymer particles containing the fine magnetic particles and the electrical charge controlling agents, and having an average diameter of 2.0 micrometers, which were referred to as polymer particle XVII.

Polymer particle XVIII

The polymer particle XVIII was prepared in the same manner as in the preparation of the particle XVII except that Ferrite EPT-1,000 (available from Toda Kogyo K.K.) was used in place of Ferrite MFP-2. The obtained polymer particle XVII had an average diameter of about 2.3 micrometers.

Polymer particle XIX

The polymer particle XIX was prepared in the same manner as in the preparation of the polymer particle XVII except that the Nigrosine Base EX was omitted. The obtained polymer particle had an average diameter of 2.5 micrometers.

Polymer particle XX

| components: | parts by weight |
|---|---|
| magnetite (BL-SP: available from Titan Kogyo K.K.) | 700 |
| styrene-acryl copolymer (Plyorite ACL: available from Goodyear Chemical Co., Ltd) | 100 |
| silica (#200: available from Nippon Airosile K.K.) | 5 |

The polymer particle XX was prepared in the same manner as in the preparation of the polymer particle XVII except that the above components were used. The average diameter of the obtained polymer particle XX was 3.2 micrometers.

Polymer particle XXI

| components: | |
|---|---|
| magnetite (BL-SP: available from Titan Kogyo K.K.) | 500 |
| polyester resin (Bylon 200: available from Toyo Boseki K.K.) | 100 |
| carbon black (MA #8: available from Mitsubishi Kasei K.K.) | 2 |

The polymer particle XXI was prepared in the same manner as in the preparation of the polymer particle XVII except that the above components were used. The average diameter of the obtained polymer particle XXI was 3.0 micron meter.

Polymer particle XXII

| components: | parts by weight |
|---|---|
| magnetic powder (EPT-1,000: available from Toda Kogyo K.K.) | 500 |
| styrene-acrylic resin (SBM-73: available from Sanyo Kasei Kogyo K.K.) | 100 |

The polymer particle XXII was prepared in the same manner as in the preparation of the polymer particle XVII except that the above components are used. The average diameter of the polymer particle XXII was 2.6 micrometers.

Polymer particle XXIII

| components: | parts by weight |
|---|---|
| ferrite (Ferrite MFP-2: available from TDK K.K.) | 500 |
| epoxy resin (Epon 1004: available from Shell Chemical Co., Ltd.) | 100 |
| carbon black (Larben 5000: available from Colombia Carbon K.K.) | 5 |

The polymer particle XXIII was prepared in the same manner as in the preparation of the polymer particle XVII except that the above components were used. The average diameter of the polymer particle XXIII was 2.2 micrometers.

Polymer particle XXIV

| components: | parts by weight |
|---|---|
| ferrite (Ferrite MFP-2: available from TDK K.K.) | 500 |
| styrene resin (Pycolustic E-125: available from Esso Chemical Co., Ltd) | 100 |

The polymer particle XXIV was prepared in the same manner as in the preparation of the polymer particle XVII except that the above components were used. The average diameter of the polymer particle XXIV was 2.6 micrometers.

Polymer particle XXV

| components: | parts by weight |
|---|---|
| polyester resin (Bylon 200: available from Toyoboseki K.K.) | 100 |
| carbon black (MA #8: available from Mitsubishi Kasei Kogyo K.K.) | 2 |

The polymer particle XXIV was prepared in the same manner as in the preparation of the polymer particle XVII except that the above components were used. The average diameter of the polymer particle XXV was 3.2 micrometers.

Preparation of carrier AA-KK

Carrier AA

The core (a) was treated with the coupling reagent (8) according to the aforementioned method to give the coupling core (a-1). The obtained coupling core (a-1), 1,000 parts by weight, and the polymer particle XVII, 20 parts by weight, were mixed at a rate of 2,000 rpm for 10 minutes by a Homogenizer (available from Nippon Seiki K.K.) and then the mixture was blended in an autoclave (TAS-1: available from Taiatsu Garasu Kogyo K.K.) under a nitrogen atmosphere of 30 kg/cm$^2$ at 700 rpm and 200° C. for 3 hours. Agglomerates in the obtained materials were removed through a sieve (105 micrometers) to give the carrier AA having an average diameter of 54 micrometers and an electrical resistance of $5.4\times10^{10}$ ohm.cm.

Carrier BB

The core (a) was treated with the coupling reagent (4) according to the aforementioned method to give the coupling core (a-1). The coupling corre (a-4), 1,000 parts by weight, and the polymer particle XX, 20 parts by weight, were mixed at 400 rpm for 10 minutes by a mill (Mechano Mill: available from Okada Seiko K.K.), and then treated with heat. Agromerates in the resultant product were eliminated by a sieve (105 micrometers) to yield the carrier BB having an average diameter of 55 micrometers and an electrical resistance of $1.7\times10^{12}$ ohm.cm.

Carrier CC

The core (b) was treated with the coupling reagent (10) according to the aforementioned method to give the coupling core (b-10). The coupling core (b-10), 1,000 parts by weight, and the polymer particle XVII, 50 parts by weight, were mixed at 10,000 rpm for 5 minutes by a mill (Multi Blender Mill: available from Nippon Seiki Seisakusho K.K.), and blended under a nitrogen atmosphere of 30 kg/cm$^2$ at 700 rpm and 200° C. for 3 hours. Agglomerates in the resultant product were treated by a sieve (105 micrometers) to give the carrier CC having an average diameter of 56 micrometers and an electrical resistance of $6.3\times10^{11}$ ohm.cm.

Carrier DD-LL

According to the combinations of the cores, coupling reagents and the polymer particles shown in Table 3 the carriers DD-LL were given.

Carrier MM

The carrier MM was prepared according to the same manner as in the preparation of the carrier KK except that the coupling treatment was omitted.

Evaluation of frictional chargeability and durability against copy

The evaluation was made in the same manner as in Example 5, except that the different carriers AA-MM were used. The results were shown in Table 4.

COMPARATIVE EXAMPLE 4

Preparation of carriers

Carrier c-8

| components: | parts by weight |
|---|---|
| Ferrite MFP-2 | 100 |
| bisphenol type polyester resin (softening point: 123° C., Tg: 65° C. AV: 21, OHV: 43, Mn: 7,600, Mw: 188,400) | 40 |

The above components were homogenously mixed in toluene under a high shear condition, to which iron powders, Ferrite TEFV 250/400 (average diameter: 50 micrometers), were added. The mixture was spry-dried to give a carrier which surface was coated having a diameter of 53 micrometers and an electrical resistance of $9.8 \times 10^{11}$ ohm.cm. This carrier is referred to as carrier c-8.

Carrier c-9

The core (a) was used as carrier c-9 without any additional treatments.

The relation of the carriers, cores, coupling reagents and polymer particles; the particle diameter and the electrical resistance were shown in Table 3.

The durability and the clearness of each carrier AA–MM, c-8 and c-9 were determined according to the evaluation in Example 3. The results are shown in Table 4.

Evaluation of frictional chargeability and durability against copy

The evaluation was made in the same manner as in Example 5, except that the different carriers c-8 and c-9 were used. The results are shown in Table 4.

TABLE 3

| Carrier | core | coupling reagent | polymer particle | particle diameter (μm) | electrical resistance ($\times 10^{11}$ μm) |
|---|---|---|---|---|---|
| AA | (a) | (8) | XVII | 54 | 5.4 |
| BB | (a) | (4) | XX | 55 | 17 |
| CC | (b) | (10) | XVII | 56 | 6.3 |
| DD | (b) | (11) | XX | 58 | 31 |
| EE | (5) | (5) | XVIII | 56 | 0.41 |
| FF | (c) | (3) | XXI | 56 | 9.8 |
| GG | (d) | (9) | XVII | 40 | 76 |
| HH | (d) | (12) | XXIV | 41 | 57 |
| II | (d) | (2) | XXIII | 40 | 81 |
| JJ | (e) | (14) | XXII | 55 | 0.78 |
| KK | (e) | (1) | XIX | 54 | 4.1 |
| LL | (f) | (6) | XXI | 50 | 4.9 |
| MM | (e) | — | XIX | 54 | 4.1 |
| c-8 | (a) | — | MFP-2 + polyester | 53 | 4.8 |
| c-9 | (a) | — | — | 50 | 0.00032 |

TABLE 4

| carrier No. | carrier diameter (μm) | toner | electrical resistance $\times 10^{10}$ Ω cm | durability chargeability (μC/g) initial | 1000 | 5000 | 10000 | 30000 | 50000 | clearness |
|---|---|---|---|---|---|---|---|---|---|---|
| AA | | (−) | 54 | −15.4 | −15.6 | −15.5 | −15.7 | −15.8 | −15.8 | E |
| | | (+) | | +13.6 | +13.6 | +13.7 | +13.5 | +13.4 | +13.3 | E |
| BB | | (−) | 170 | −15.3 | −15.3 | −15.2 | −15.3 | −15.4 | −15.4 | E |
| | | (+) | | +13.2 | +13.4 | +13.3 | +13.2 | +13.1 | +13.0 | E |
| CC | | (−) | 6.3 | −15.1 | −15.2 | −15.4 | −15.5 | −15.6 | −15.7 | E |
| | | (+) | | +13.4 | +13.3 | +13.3 | +13.3 | +13.2 | +13.0 | E |
| DD | | (−) | 310 | −15.7 | −15.8 | −15.9 | −15.7 | −15.7 | −15.8 | E |
| | | (+) | | +13.1 | +13.3 | +13.1 | +12.9 | +12.9 | +12.8 | E |
| EE | | (−) | 4.1 | −15.1 | −15.1 | −15.3 | −15.5 | −15.6 | −15.7 | E |
| | | (+) | | +13.6 | +13.8 | +13.7 | +13.6 | +13.4 | +13.2 | E |
| FF | | (−) | 98 | −14.8 | −14.8 | −15.1 | −15.2 | −15.3 | −15.3 | E |
| | | (+) | | +13.2 | +13.2 | +13.1 | +13.1 | +13.0 | +12.8 | E |
| GG | | (−) | 760 | −15.3 | −15.3 | −15.2 | −15.5 | −15.6 | −15.7 | E |
| | | (+) | | +13.5 | +13.2 | +13.3 | +13.1 | +13.2 | +13.0 | E |
| HH | | (−) | 570 | −15.1 | −15.4 | −15.2 | −15.3 | −15.4 | −15.3 | E |
| | | (+) | | +12.9 | +13.1 | +13.2 | +13.0 | +13.0 | +12.8 | E |
| II | | (−) | 810 | −16.1 | −16.3 | −16.3 | −16.2 | −16.3 | −16.4 | E |
| | | (+) | | +12.8 | +12.9 | +13.1 | +12.9 | +12.8 | +12.9 | E |
| JJ | | (−) | 7.8 | −15.3 | −15.4 | −15.3 | −15.2 | −15.3 | −15.4 | E |
| | | (+) | | +13.2 | +13.3 | +13.2 | +13.4 | +13.4 | +13.3 | E |
| KK | | (−) | 41 | −15.6 | −15.5 | −15.5 | −15.7 | −15.9 | −16.0 | E |
| | | (+) | | +13.2 | +13.2 | +13.2 | +13.0 | +12.8 | +12.9 | E |
| LL | | (−) | 49 | −13.2 | −13.3 | −13.5 | −13.3 | −13.1 | −13.1 | E |
| | | (+) | | +15.3 | +15.2 | +15.4 | +15.4 | +15.5 | +15.7 | E |
| MM | | (−) | | −15.6 | −15.5 | −15.6 | −15.7 | −15.8 | −15.8 | E |
| | | (+) | | +13.2 | +13.1 | +13.2 | +13.0 | +13.0 | +12.8 | E |
| c-8 | | (−) | 98 | −15.0 | −15.6 | −15.8 | −16.3 | −16.8 | −18.1 | I |
| | | (+) | | +13.2 | +13.5 | +13.4 | +13.1 | +12.5 | +11.5 | B |
| c-9 | | (−) | 0.00032 | −5.8 | −6.0 | −6.3 | −7.0 | −7.1 | −7.5 | B |
| | | (+) | | +3.5 | +3.2 | — | — | — | — | B |

EXAMPLE 8

Durability of carrier KK

After the developer containing the carrier KK with the negative toner or the positive toner was used in the above 50,000 sheets copying test, each developer was stirred in the same developing machine (in the case of negative toner EP-4702 (available from Minolta Camera K.K.) and in the case of positive toner EP-870 (available from Minolta Camera K.K.)) for 50 hours without any supplements of the developer, toner and paper. After that, the charged amount on the toner was determined, and then a copy was made using the each developer to evaluated the clearness. According to a similar manner the carrier MM was examined. The results are shown in Table 5. In the carrier KK no fog on the image after this durability test was observed, and in the carrier MM without the coupling treatment a few fog was observed but it is no problem in practice. These results shown that the carrier KK, which was treated with a coupling reagent, apparently has an excellent durability even when the developer was used for long time.

TABLE 5

| carrier | charge amount (μC/g) after 50,000 sheets copy | after 50 hours stirring | clearness |
|---|---|---|---|
| carrier KK | −16.0 | −16.1 | E |

TABLE 5-continued

| carrier | charge amount (μC/g) after 50,000 sheets copy | after 50 hours stirring | clearness |
|---|---|---|---|
| | +12.9 | +12.8 | E |
| carrier MM | −15.8 | −17.3 | G |
| | +12.8 | +10.3 | G |

What is claimed is:

1. A carrier for use in a developing device for an electrostatic latent image, which carrier comprises a magnetic core and a coating layer formed over said magnetic core, said coating layer comprising fine magnetic particles in an amount sufficient to provide said carrier with an electrical resistance of from $10^{10}$ to $10^{15}$ ohm cm.

2. A carrier of the claim 1, in which the average diameter of the core is from 20 to 200 micrometers.

3. A carrier of the claim 1, in which the average diameter of the polymer particles is from 0.6 to 10 micrometers.

4. A carrier of the claim 1, in which the average diameter of the fine magnetic particles is from 0.01 to 3 micrometers.

5. A carrier of the claim 1, in which the ratio of the coating layer containing the fine magnetic particles to the core is from 0.05:100 to 50:100 by weight.

6. A carrier of the claim 1, in which the ratio of the fine magnetic particles to the coating layer is from 100:100 to 800:100 by weight.

7. A carrier of the claim 1, in which the core is selected from the group consisting of ferrite, iron, iron alloy, nickel, nickel alloy, cobalt, and cobalt alloy.

8. A carrier of the claim 1, in which the polymer particles are selected from the group consisting of homo- or copolymer of styrenes, acryl monomers, methacryl monomers, vinyl monomers, polyfunctional acrylates, polyfunctional methacrylates, and divinyl monomers.

9. A carrier of the claim 1, in which the fine magnetic particles are selected from the group consisting of ferrite, iron, iron alloy, nickel, nickel alloy, cobalt, and cobalt alloy.

10. A carrier of the claim 1, in which the core is treated with coupling reagents.

11. A carrier of the claim 10, in which the coupling reagents are selected from the group consisting of silicone coupling reagents, titanate coupling reagents, zilconium coupling reagents and aluminium coupling reagents.

12. A carrier for use in a developing device for an electrostatic latent image, which carrier comprises a magnetic core and a coating layer formed over said magnetic core, wherein said coating layer comprises fine magnetic particles and electrical charge controlling agents in an amount sufficient to provide said carrier with an electrical resistance of from $10^{10}$ to $10^{15}$ ohm cm.

13. A carrier of the claim 12, in which said coating layer comprises polymer particles containing both said electrical charge controlling agents and said fine magnetic particles.

14. A carrier of the claim 12, in which the coating layer comprises polymer particles and electrical charge controlling agents, said polymer particles containing said fine magnetic particles and formed over the magnetic core, and said electrical charge controlling agents are formed to adhere to the surface of said polymer particles.

15. A carrier of the claim 12, in which the coating layer comprises two different types of polymer particles, one of which contains electrical charge controlling agents and the other of which contains fine magnetic particles.

16. A carrier of the claim 12, in which the electrical charge controlling agents are selected from the group consisting of nigrosines, thioindigos, salicylic acid metal chelating agents, and sulfonyl amine derivatives of copper phthalocyanines.

17. A carrier of the claim 12, in which the average diameter of the core is from 20 to 200 micrometers.

18. A carrier of the claim 13, 14 or 15, in which the average diameter of the polymer particles is from 0.6 to 10 micrometers.

19. A carrier of the claim 12, in which the average diameter of the fine magnetic particles is from 0.01 to 3 micrometers.

20. A carrier of the claim 12, in which the ratio of the coating layer containing the fine magnetic particles to the core is from 0.05:100 to 50:100 by weight.

21. A carrier of the claim 13, 14 or 15, in which the ratio of the fine magnetic particles to the polymer particles is from 100:100 to 800:100 by weight.

22. A carrier of the claim 12, in which the core is selected from the group consisting of ferrite, iron, iron alloy, nickel, nickel alloy, cobalt, and cobalt alloy.

23. A carrier of the claim 13, 14 or 15, in which the polymer particles are selected from the group consisting of homo- or copolymer of styrenes, acryl monomers, methacryl monomers, vinyl monomers, polyfunctional acrylates, polyfunctional methacrylates, and divinyl monomers.

24. A carrier of the claim 12, in which the fine magnetic particles are selected from the group consisting of ferrite, iron, iron alloy, nickel, nickel, alloy, cobalt, and cobalt alloy.

25. A carrier of the claim 12, in which the core is treated with coupling reagents.

26. A carrier of the claim 25, in which the coupling reagents are selected from the group consisting of silicone coupling reagents, titanate coupling reactant, zirconium coupling reagents and aluminium coupling reagents.

27. A method of preparing a carrier for use in a developing device for an electrostatic latent image, which comprises homogeneously mixing magnetic cores with polymer particles containing fine magnetic particles and having a smaller diameter than that of the magnetic cores, and welding the polymer particles on said magnetic core at a temperature higher than the softening point of the polymer particles.

28. A method of preparing a carrier of the claim 27, in which the magnetic cores are treated with coupling reagents before mixing the cores and the polymer particles.

29. A method of the claim 27, in which the welding process is carried out under an inert atmosphere.

30. A method of the claim 27, in which the average diameter of the cores is from 20 to 200 micrometers.

31. A method of the claim 27, in which the average diameter of the polymer particles is from 0.6 to 10 micrometers.

32. A method of the claim 27, in which the average diameter of the fine magnetic particles is from 0.01 to 3 micrometers.

33. A carrier of the claim 27, in which the ratio of the polymer particles containing the fine magnetic particles to the core is from 0.05:100 to 50:100 by weight.

34. A method of the claim 27, in which the ratio of the fine magnetic particles to the polymer particles is from 100:100 to 800:100 by weight.

35. A method of the claim 27, in which the core is selected from the group consisting of ferrite, iron, iron alloy, nickel, nickel alloy, cobalt, and cobalt alloy.

36. A method of the claim 27, in which the polymer particles are selected from the group consisting of homo- or copolymer of styrenes, acryl monomers, methacryl monomers, vinyl monomers, polyfunctional acrylates, polyfunctional methacrylates, and divinyl monomers.

37. A method of the claim 27, in which the fine magnetic particles are selected from the group consisting of ferrite, iron, iron alloy, nickel, nickel alloy, cobalt, and cobalt alloy.

38. A method of preparing carriers for use in a developing device for an electrostatic latent image, which comprises homogeneously mixing magnetic cores with polymer particles containing fine magnetic particles and electrical charge controlling agents, in which the polymer particle is smaller than the cores, and welding the polymer particles on the magnetic cores at a temperature higher than the softening point of the polymer particle.

39. A method of the claim 38, in which the welding process is carried out under atmosphere of an inert gas.

40. A method of the claim 38, in which the magnetic cores are treated with coupling reagents before the cores and the polymer particles are mixed.

41. A method of preparing carriers for use in a developing device for an electrostatic latent image comprising homogeneously mixing magnetic cores with polymer particles containing fine magnetic particles, in which the polymer particles are smaller than the cores, and welding the polymer particles on the magnetic cores, and coating electrical charge controlling agents on the polymer-welded cores.

42. A method of claim 41, in which the welding process is carried out under atmosphere of an inert gas.

43. A method of claim 41, in which the magnetic cores are treated with coupling reagents before the cores and the polymer particles are mixed.

44. A carrier of the claim 1, in which the coating layer comprises polymer particles containing fine magnetic particles.

45. A carrier of claim 1, in which the ratio of the fine magnetic particles to the coating layer is from 300:100 to 700:100 by weight.

46. A carrier of claim 1, in which the ratio of the fine magnetic particles to the coating layer is from 400:100 to 600:100 by weight.

47. A carrier of the claim 13, 14 or 15, in which the ratio of the fine magnetic particles to the polymer particles is from 300:100 to 700:100 by weight.

48. A carrier of the claim 13, 14 or 15, in which the ratio of the fine magnetic particles to the polymer particles is from 400:100 to 600:100 by weight.

49. A method of the claim 27, in which the ratio of the fine magnetic particles to the polymer particles is from 300:100 to 700:100 by weight.

50. A method of the claim 27, in which the ratio of the fine magnetic particles to the polymer particles is from 400:100 to 600:100 by weight.

* * * * *